United States Patent [19]

Crise

[11] 4,207,650

[45] Jun. 17, 1980

[54] CLEANER USING HIGH VELOCITY AIR JETS HAVING A DOUBLE VALVE HAVING AN EQUAL NUMBER OF JET NOZZLES OPERATING AT ALL TIMES

[76] Inventor: W. Paul Crise, 4921 NE. 2nd Ave., Pompano Beach, Fla. 33064

[21] Appl. No.: 15,877

[22] Filed: Feb. 27, 1979

Related U.S. Application Data

[63] Continuation-in-part of Ser. No. 786,257, Apr. 11, 1977, Pat. No. 4,141,103.

[51] Int. Cl.[2] ..... A47L 5/14

[52] U.S. Cl. ..... 15/404; 15/346; 15/405

[58] Field of Search ..... 15/345, 346, 404, 405, 15/421

[56] References Cited

U.S. PATENT DOCUMENTS

| | | | |
|---|---|---|---|
| 2,321,648 | 6/1943 | Brunner | 15/404 |
| 2,864,119 | 12/1958 | Crise | 15/404 |
| 3,107,386 | 10/1963 | Mandin | 15/345 |
| 3,268,942 | 8/1966 | Rossnan | 15/346 |

*Primary Examiner*—Christopher K. Moore
*Attorney, Agent, or Firm*—Malin & Haley

[57] ABSTRACT

This disclosure shows the supplying of fluid at a pressure greater than the pressure of the surrounding atmosphere to a cleaner in which the cleaning is done by intermittently and consecutively jetting fluid, controlled by a double distributing valve against the surface of the material being cleaned, where the total average pressure of the air or gas is maintained at a few inches of water below the pressure of the surrounding atmosphere. The double distributing valve, having circular outlets evenly spaced around a valve rotor, allows the same number of passages leading from the valve rotor cavity to jet nozzles to be in operation at all times and allows an increase in time for the jetting fluid through the jet nozzles to reach the desired speed.

4 Claims, 10 Drawing Figures

Fig. 1.
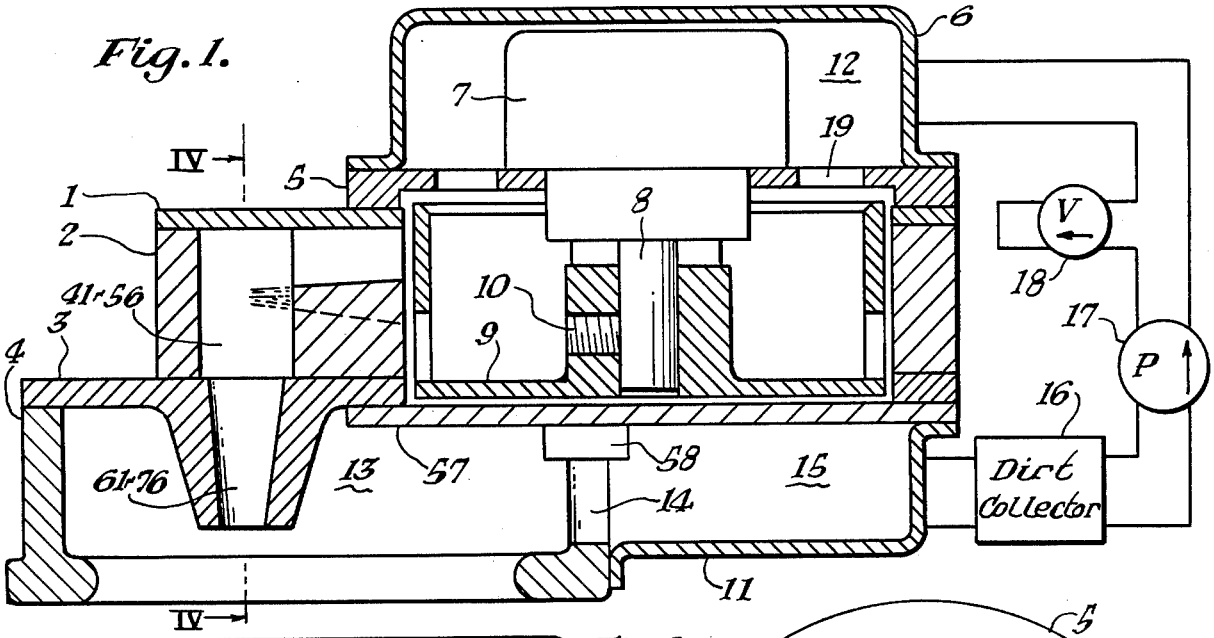
Fig. 2.
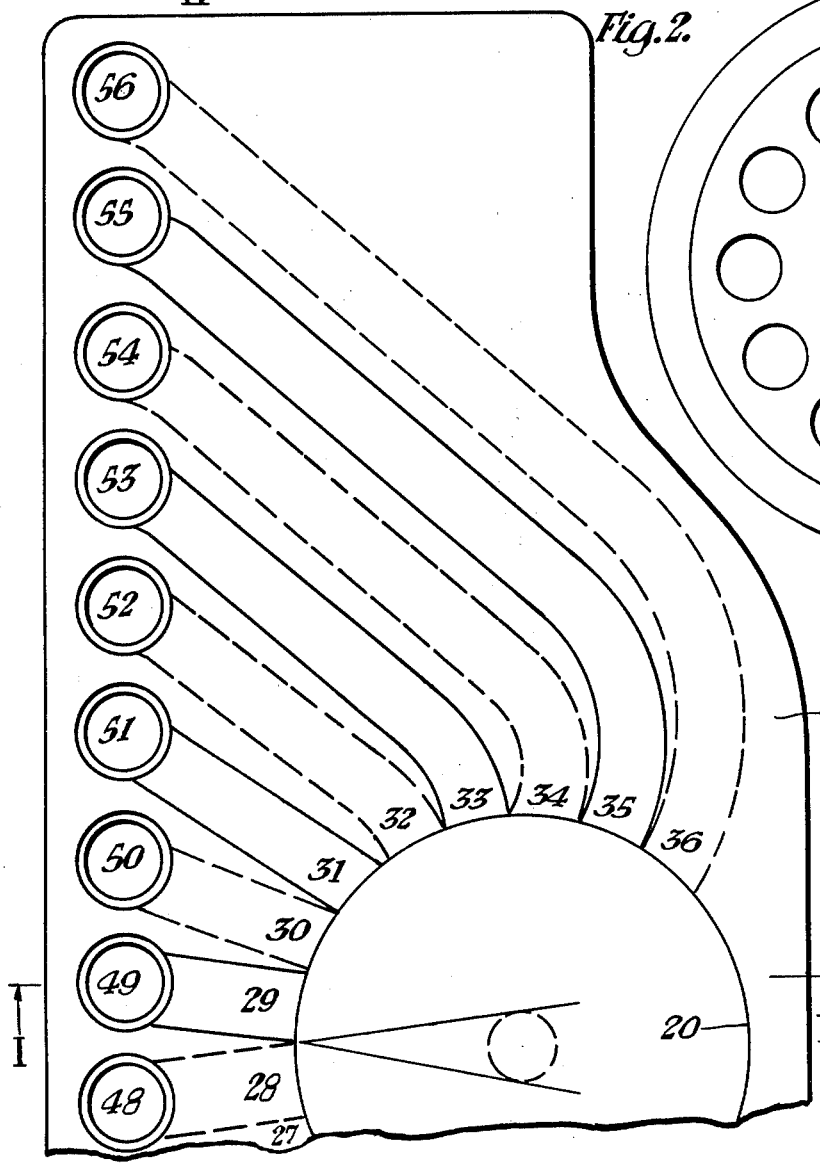
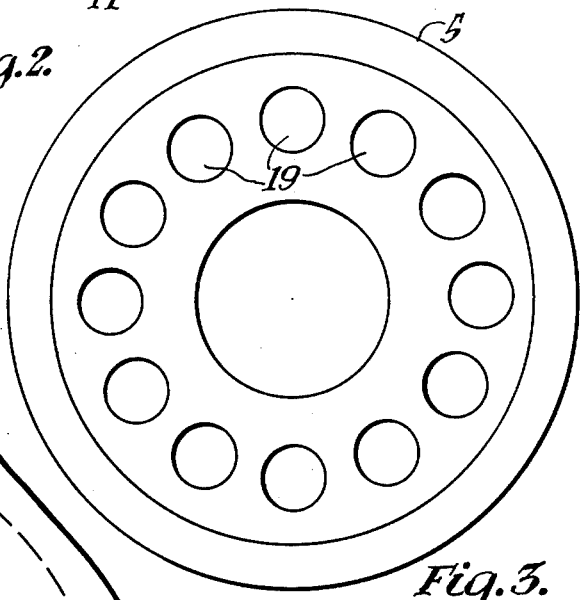
Fig. 3.
Fig. 4.
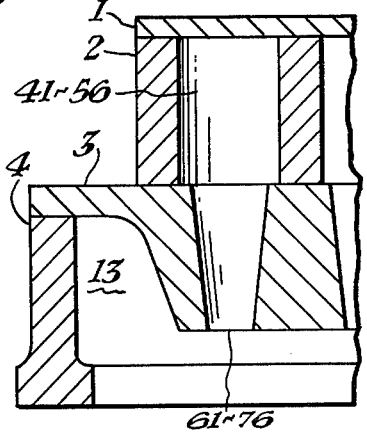

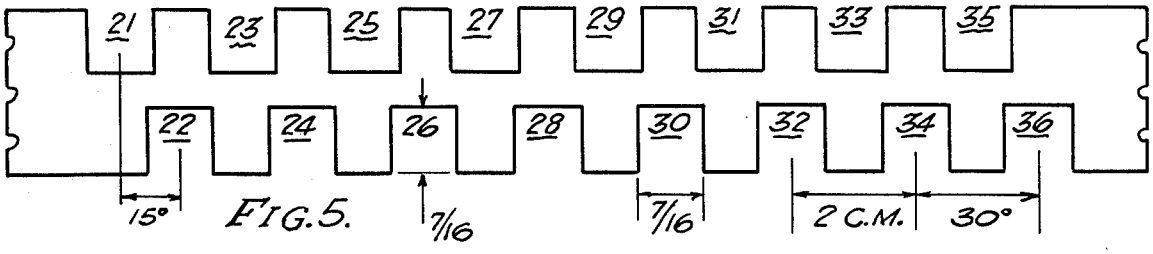
FIG. 5.
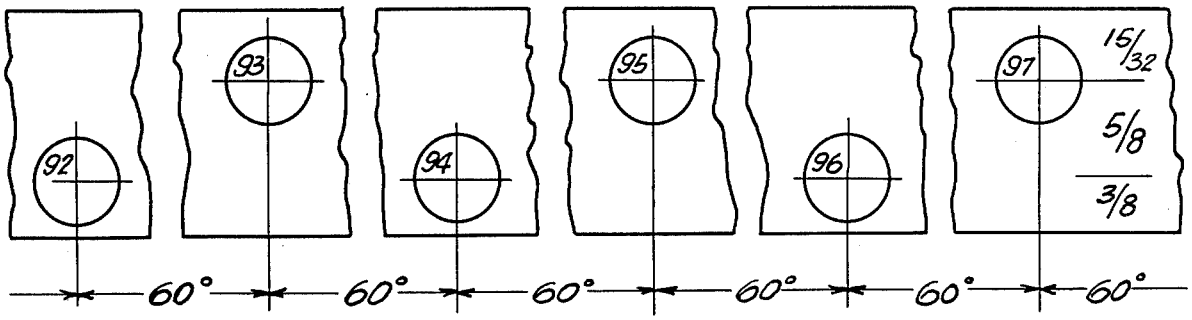
FIG. 6.
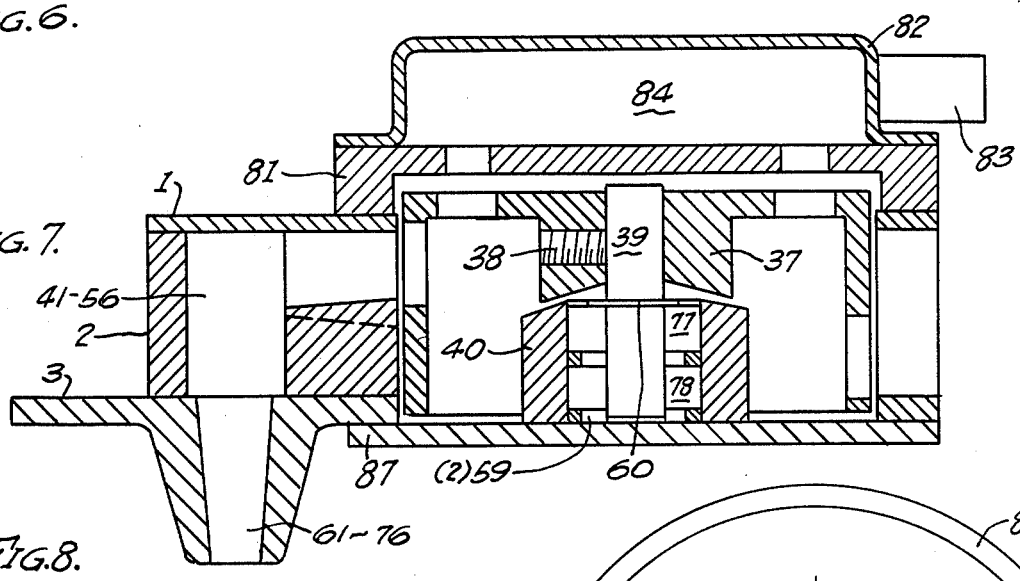
FIG. 7.
FIG. 8.
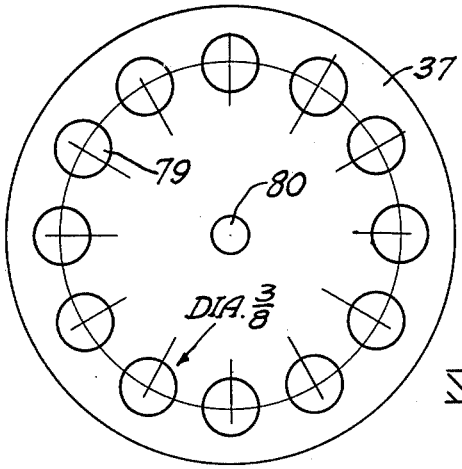
FIG. 9.
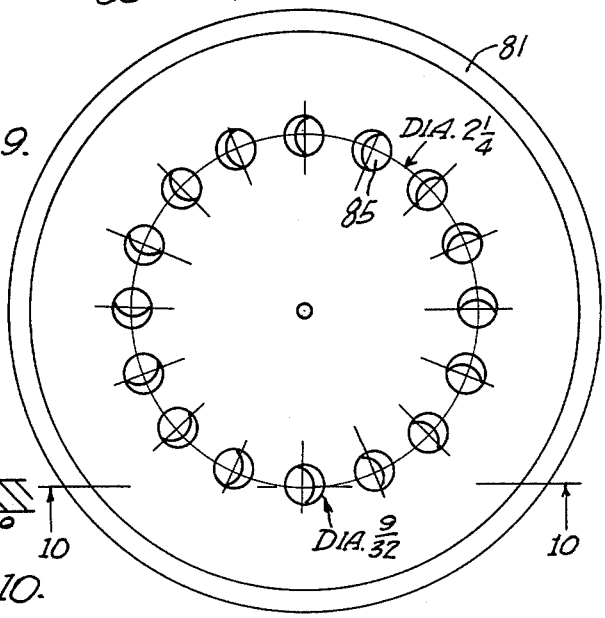
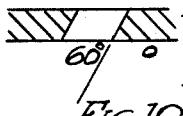
FIG. 10.

CLEANER USING HIGH VELOCITY AIR JETS HAVING A DOUBLE VALVE HAVING AN EQUAL NUMBER OF JET NOZZLES OPERATING AT ALL TIMES

CROSS-REFERENCES TO RELATED APPLICATIONS

This application is a continuation-in-part of my prior co-pending application, Ser. No. 786,257, filed Apr. 11, 1977, now U.S. Pat. No. 4,141,103, issued Feb. 27, 1979.

BACKGROUND OF THE INVENTION

Various types of cleaners are commonly used to supply intermittent jets of fluid for cleaning carpets. Such devices are disclosed in my U.S. Pat. Nos. 2,864,119, 4,017,938 and 4,141,103.

SUMMARY OF THE INVENTION

This invention relates generally to a cleaner that supplies intermittent jets of fluid for cleaning carpets, and more particularly to a cleaner using a double distributing valve, one valve located above the other. This double valve makes possible a substantially larger, more effective and efficient cleaner. A single member of molded plastic is the circular portion of the rotor cavity for the single rotor, that has discharge openings that register with and supply air independently to both the top and bottom sections of the stator. The above mentioned single member of molded plastic also contains all the passages that connect the rotor cavity to all of the jet nozzle passages. In this cleaner, the passages leading from the valve rotor cavity to the space above the jet nozzle passages do not increase in width after they leave the valve rotor cavity; instead, they increase in depth as the passages become longer and do so as a function of the length of the passages. Since the passages leading from the valve rotor cavity do not increase in width, much less horizontal space is required by these passages and the jet nozzle passages may be placed closer together. The upper portion of the double valve supplies air to fully opened upper passages, while the lower portion of the valve will be changing passages. The reverse of this arrangement will immediately follow as the rotor continues to rotate. By this arrangement, air from a jet nozzle passage is never interfered with by air flowing from an adjacent passage. Also, the double valve doubles the space available for the passages leading from the valve rotor cavity to the jet nozzle passages, greatly increasing the efficiency of the cleaning tool. The double valve makes it easy to produce a larger cleaning tool that is more effective and efficient and with the jet nozzle passages close enough together so that one pass over the material being cleaned will do a good job of cleaning. The circular outlets of the valve rotor are easier to produce than oblong outlets and having the circular outlets evenly spaced at 60 degrees permits the cleaning tool to have the same number of passages leading from the valve rotor cavity to the jet nozzles in operation at all times.

It is an object of the present invention to provide a cleaning tool that will have the same number of passages leading from the valve rotor cavity to the jet passages in operation at all times.

It is another object of the present invention to provide a cleaning tool that is sufficiently quiet for household use.

It is a further object of the present invention to provide a cleaning tool that allows an increase in the time available for the speed of the air through the jet nozzles to reach the desired speed to discharge 6,000 high speed jets from each jet nozzle because of a reduction in the rotational speed of the valve rotor.

It is an additional object of the present invention to rotate the valve rotor at a reduced speed of 2,000 R.P.M. and still maintain 6,000 high speed jets from each jet nozzle per minute, thus reducing unwanted noise.

In accordance with these and other objects which will be apparent hereinafter, the instant invention will now be described with particular reference to the accompanying drawings.

BRIEF DESCRIPTION OF THE DRAWINGS

FIG. 1 is a side view in section, taken along line 1—1 of FIG. 2. In this view, the rotor of the double valve is rotated by an electric motor.

FIG. 2 is a top view of 2. 2 is planned to be molded as a single piece of plastic, the left and right portions being identical.

FIG. 3 is a bottom view of 5.

FIG. 4 is a partial right front view of the cleaning tool in section, taken along line 4—4 of FIG. 1.

FIG. 5 shows the sixteen passages, 21 through 36, in 2 that lead from the valve rotor cavity in 2 to the spaces 41 through 56 in 2 above the jet passages 61 through 76 in 3.

FIG. 6 shows the outside surface of rotors 9 and 37 and the location of the six circular openings through the outer wall of 9 and 37.

FIG. 7 is a partial side view of the cleaning tool, having a double valve that is rotated by the air that passes through it and which it distributes, in section taken along 1—1 of FIG. 2.

FIG. 8 is a top view of 37.

FIG. 9 is a bottom view of 81.

FIG. 10 is a partial view in section taken along line 10—10 of 81 and shows how the holes in 81 pass through it an an angle of approximately 60 degrees.

DESCRIPTION OF THE PREFERRED EMBODIMENT

As shown in FIG. 1, the top and bottom surfaces of 1, 2, 3, 4, 5 and 57 should be flat and smooth so that when fastened together, they would make substantially airtight contact. The bottom of 9 should also be flat and smooth. A gasket may be used to assist 6 to make airtight contact with 5 and may be used to assist 11 to make airtight contact with 4 and 57.

1 can be stamped from ⅛ inch aluminum sheet and its horizontal dimensions are the same as 2 as is shown in FIG. 2. 2 is a single member of molded plastic containing the passages 21–36 that connect the rotor cavity to all of the jet nozzle passages 61–76. In this cleaner, the passages 21–36 leading from the valve rotor cavity to the space above the jet nozzle passages 61–76 do not increase in width after they leave the valve rotor cavity; instead, they increase in depth as the passages become longer and do so as a function of the length of the passages. Since the passages leading from the valve rotor cavity do not increase in width, much less horizontal space is required by these passages and the jet nozzle passages may be placed closer together. 3 can be die cast of aluminum or molded of good plastic. Its horizontal dimensions are the same as 1 and 2, except it is about 2 13/16 inches longer than 1 and 2, as is shown in FIG. 4, the overall width of the cleaning tool being about 15 inches. After 1, 2 and 3 are fastened together, the vertical hole through them should be bored or broached to size.

Electric motor 7 used to rotate valve rotor 9, as shown in FIG. 1, is not intended to show how a suitable motor looks, but is to indicate where it would be located and how it would be connected to valve rotor 9 by shaft 8.

5, as shown in FIGS. 1 and 3, has a shallow circular cavity of about 3 1/6 inches in diameter and 12 holes of about 7/16 of an inch in diameter that allow air to flow freely from space 12 to the open end of cup-shaped rotor 9. 5 also has a larger hole in its center of a diameter that allows electric motor 7 to slip freely but snugly through. When electric motor 7 is in place in 5, said motor 7 should be firmly fastened to 5. When the subassembly of 5, 6, 7 and 9 is being fastened to 1, it may be necessary to move the subassembly slightly in a horizontal direction to center the valve rotor in the cylindrical part of the valve rotor cavity made up of 1, 2 and 3. This can be done by using screws passing through holes in 5 and 6 into matching tapped holes in 1, the diameter of the holes in 5 and 6 being made larger than the diameter of the screws to provide for the needed adjustment.

The double valve rotor 9 is a cup-shaped member having a hub extending upward from the bottom of the cup. As shown in FIG. 6, the outer wall of the rotor has six circular openings through it spaced 60 degrees apart and positioned vertically so that they register alternately with the odd or even numbered passages 21 through 36 as shown in FIG. 5. The hole through the center of the hub of 9 should have such a size that the hub can slip freely but snugly over shaft 8 of electrical motor 7. Tapped hole 10 in the hub of 9 should be provided with a suitable set screw.

57 should be about $3\frac{3}{4}$ inches square and about $\frac{1}{8}$ inch thick and made from aluminum or other suitable material. 4 is a rectangular member of die cast aluminum or other suitable material having outside dimensions of about $3\frac{7}{8}$ inches wide, 15 inches long and $1\frac{1}{4}$ inches high. It has a substantially rectangular opening through its lower portion about $2\frac{5}{8}$ inches wide and about $13\frac{3}{4}$ inches long. The rear portion of 4 has a notch in its center. The top of the notch is about $3\frac{3}{4}$ inches wide by about $\frac{1}{8}$ of an inch deep to allow 57 to slip down in it when 4 is being fastened to 3. In the center of this notch, it is increased in depth about $\frac{3}{4}$ of an inch to make passage 14, that connects space 13, above where the cleaning by the high velocity jets of air takes place, to space 15 in the exhaust manifold. 58 is a piece of aluminum or other suitable material about 2 inches long and about $\frac{1}{4}$ inch deep by about $\frac{1}{2}$ inch wide. It is fastened to the top of passage 14 to reduce its cross-sectional area of the passage so that the velocity of the air flowing through it will be high enough to carry the dirt loosened by the high speed jets with it.

The portion of 3 that extends about $\frac{3}{4}$ of an inch down from the flat portion of 3 that rests on 4, contains sixteen jet nozzle passages 61 through 76. These passages have an inside diameter of about 5/16 of an inch at their lower end. This diameter increases as the passages extend upward at an included angle of approximately 10 degrees.

As previously noted, FIG. 7 is a partial side view in section taken along line 1—1 of FIG. 2 of a cleaning tool having a double valve, the rotor of which is rotated by the air that passes through it and which it distributes. Many of the parts used in this cleaner are identical to parts used in the cleaner shown in FIG. 1 using a double valve, the rotor of which is rotated by an electric motor. 1, 2 and 3 shown in FIG. 7 are identical; 4–58 and 11 not shown are identical and all that is shown in FIGS. 2, 4, 5 and 6 are identical. 87, shown in FIG. 7, has the same overall dimensions as 57 in FIG. 1.

87 is a piece of aluminum or other suitable material about $3\frac{3}{4}$ inches square and about $\frac{1}{8}$ inch thick. 87 is fastened to 3 by screws passing through holes in 87 into matching tapped holes in 3. The diameter of the holes in 87 are larger than the diameter of the screws so that 87 can be adjusted horizontally before the screws are tightened. As shown in FIG. 7, 40 is made of aluminum or other suitable material and has an outside diameter of about $1\frac{1}{2}$ inches and an inside bore of about $\frac{7}{8}$ of an inch to fit the outside diameter of ball bearings 77 and 78. The lower end of 40 should be square with its inside bore and have a smooth finish. 40 should be located in the center of 87 and firmly fastened to it. Bearings 77 and 78 could be Nice 1604DS double shield bearings. 59 is a thin spacer having an outside diameter of about $\frac{7}{8}$ of an inch. 39 is a piece of about $\frac{3}{8}$ inch diameter drill rod and has a groove in it as shown in FIG. 7, in which retaining ring 60 is placed. Valve rotor 37 is shown in FIGS. 7 and 8, is an upside down, cup-shaped member with an outside diameter of about 2 31/32 inches. Its outside wall has six circular openings through it located as shown in FIG. 6. As shown in FIGS. 7 and 8, which is a top view of rotor 37, shows twelve holes about $\frac{3}{8}$ inches in diameter through the top of 37. Hole 80 through the center of 37 should be of a size to slip easily but snigly over shaft 39. Tapped hole 38 through the hub of rotor 37 should be supplied with a suitable set screw. The shallow circular cavity in 81, as shown in FIG. 9, should have a diameter of about 3 1/6 inches. FIG. 10 is a partial view in section taken along line 10—10 of FIG. 9 and shows how eighteen holes about 7/32 inches in diameter pass through 81 at an angle of about 30 degrees from the vertical. The cleaning tool, having a double valve, the rotor of which is rotated by the air that passes through it and which distributes as shown in FIG. 7, is assembled in the same way as the cleaning tool shown in FIG. 1, except the locating of the valve rotor in the valve rotor cavity is done by adjusting the member that is the bottom of the valve rotor cavity horizontally instead of the top member of the valve rotor cavity.

The use of two small ball bearings, one above the other, instead of one larger bearing, has important advantages. The smaller bearings have less axial play and with the shaft being supported by two bearings, one above the other, the valve rotor will rotate more smoothly and with less tendency to wobble than if it were supported by a larger and much more expensive precision bearing. by requiring less horizontal space, more space for air flow is available. The use of more vertical space is not a problem since the double valve also requires more vertical space. Fafnir and other manufacturers manufacture similar size bearings, but Nice is also precision ground and adequate for the extremely light loading in this application.

As shown in FIG. 6, the valve rotors 9 and 37 have six discharge openings 92–97. The discharge openings 92–97 are positioned 60 degrees apart such that four of the passages 21–36 will be in operation at all times. The upper discharge openings will be fully open to upper passages, while the lower portion discharge openings will be changing passages, but the reverse of this operation will immediately follow as the valve rotor rotates.

To discharge 6,000 high speed jets from each jet nozzle per minute where only four oblong discharge openings are available, requires the valve rotor to rotate at 3,000 R.P.M. However, the present invention, having six circular discharge openings, requires only 2,000 R.P.M. to discharge 6,000 high speed jets, thus the present invention increases the time available for the speed of the air through the jet nozzles to reach the desired speed by one half. This 50% increase in time allows the velocity to build up and the reduced rotational speed of the valve rotor decreases undesired vibration and noise.

In the cleaning tool shown in a side view in section in FIG. 1, its double valve rotor is rotated by an electric motor. In the cleaning tool shown in a partial side view in section in FIG. 7, its double valve rotor is rotated by the air that passes through it and that it distributes. In the cleaning tool using a double valve, the valve rotor could be rotated by other means than those shown in the drawings and the specification, such as by an air driven turbine or by the wheels that support the cleaning tool being connected to the valve rotor by suitable gearing. Considering the above, and since U.S. Pat. No. 2,864,119 covering the rotating of the valve rotor by the air that flows through it and which it distributes, had been issued for 17 years on Dec. 24, 1975, this patent is no longer in effect, and that the restricting statement that the valve rotor is rotated by the air that flows through it, is not necessary to make a claim patentable.

The drawings and the specification show a preferred form of this invention. The double valve has made much better use of space and material and has made possible a more effective cleaning tool than is possible with a single valve and the double valve having six circular discharge openings, have made possible a more efficient and quiet cleaning tool.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A cleaning tool for carpet or material, including, an elongated member connected throughout its length with a normally substantially horizontal elongated opening, adapted to engage the surface of the material being cleaned; an elongated cavity, permanently open to the opening, and ending as an outlet opening, said elongated member having a plurality of nozzle passages for discharging gas from a valve rotor cavity against the material being cleaned, positioned above where the elongated opening engages the surface of the material, and spaced longitudinally along the length of said member, said outlet opening connected to the inlet of a gas moving means; a cylindrical valve rotor cavity connected through inlet passages from the outlet of said gas moving means to an inlet manifold, and having a plurality of outlet passages spaced around the circumference of said rotor cavity, arranged in a plurality of rows, one row above the other leading away from it, each outlet passage connecting separately to at least one of the nozzle passages for discharging jets of gas from said valve rotor cavity against the material being cleaned, siad outlet passages leading from the cylindrical valve rotor cavity to the nozzle passages being so proportioned that the areas of their cross-sections vary substantially in proportion to a function of their length, the areas of their cross-sections increasing gradually as the passages leave the valve rotor cavity, until the areas of their crosssections reach a desired value; a rotatable valve member positioned in said valve rotor cavity, wherein the improvement comprises:

a plurality of circular outer wall openings of said valve rotor member arranged in a plurality of rows one row above the other, positioned vertically so that said openings in the outer wall of said valve rotor member will be on the same level as that of the outlet passages leading from the cylindrical valve rotor cavity to the jet nozzle passages, said openings in the outer wall of the valve rotor being so positioned around its circumference that when rotated, the same number of jet nozzle passages will receive gas at all times;

said valve rotor being connected to means adapted to rotate the valve rotor at the desired speed.

2. A cleaning tool as set forth in claim 1, wherein:

said circular outer wall openings are spaced sixty degrees apart around the circumference of said rotor cavity.

3. A cleaning tool as set forth in claim 2, wherein:

for outlet passages leading to said jet nozzle passages will receive gas from said cylindrical valve rotor cavity outer wall openings at all times.

4. A cleaning tool as set forth in claim 3, wherein:

said valve rotor cavity rotates substantially at 2,000 revolutions per minute.

* * * * *

UNITED STATES PATENT AND TRADEMARK OFFICE

CERTIFICATE OF CORRECTION

PATENT NO. : 4,207,650

DATED : June 17, 1980

INVENTOR(S) : W. Paul Crise

It is certified that error appears in the above—identified patent and that said Letters Patent is hereby corrected as shown below:

Claim 3, line 2, delete "for", and insert therefore --four--.

Signed and Sealed this

*Ninth* Day of *September 1980*

[SEAL]

*Attest:*

SIDNEY A. DIAMOND

*Attesting Officer*

*Commissioner of Patents and Trademarks*